US008844149B2

(12) United States Patent
Madderom et al.

(10) Patent No.: US 8,844,149 B2
(45) Date of Patent: Sep. 30, 2014

(54) RAIL CANT MEASUREMENT TOOL AND METHOD

(75) Inventors: Robert N. Madderom, Mokena, IL (US); Harold T. Ruggles, Merrillville, IN (US); Stefan T. Pendrick, Hammond, IL (US); Brandon R. Huynh, Dyer, IN (US)

(73) Assignee: Holland, L.P., Crete, IL (US)

( * ) Notice: Subject to any disclaimer, the term of this patent is extended or adjusted under 35 U.S.C. 154(b) by 169 days.

(21) Appl. No.: 13/614,024

(22) Filed: Sep. 13, 2012

(65) Prior Publication Data

US 2013/0061482 A1 Mar. 14, 2013

Related U.S. Application Data

(60) Provisional application No. 61/573,818, filed on Sep. 13, 2011.

(51) Int. Cl.

| | |
|---|---|
| ***E01B 35/02*** | (2006.01) |
| ***B61K 9/08*** | (2006.01) |
| ***E01B 35/00*** | (2006.01) |

(52) U.S. Cl.

CPC .. *B61K 9/08* (2013.01); *E01B 35/00* (2013.01)
USPC ..... 33/338; 33/533

(58) Field of Classification Search

USPC ..... 33/1 Q, 338, 521, 523.1, 533
See application file for complete search history.

(56) References Cited

U.S. PATENT DOCUMENTS

| | | | | |
|---|---|---|---|---|
| 3,604,359 | A * | 9/1971 | Doorley et al. | 33/338 |
| 5,025,566 | A * | 6/1991 | Fiechter | 33/338 |
| 5,189,798 | A * | 3/1993 | La Force | 33/1 Q |
| 5,848,476 | A * | 12/1998 | Grady | 33/1 Q |
| 6,564,467 | B1 * | 5/2003 | Kay et al. | 33/1 Q |
| 7,979,995 | B2 * | 7/2011 | Theurer et al. | 33/1 Q |
| 2002/0083607 | A1 * | 7/2002 | Atsuhiko et al. | 33/533 |
| 2004/0173033 | A1 * | 9/2004 | Gilbert | 33/1 Q |
| 2010/0237857 | A1 * | 9/2010 | Holfeld | 33/338 |

* cited by examiner

*Primary Examiner* — G. Bradley Bennett
(74) *Attorney, Agent, or Firm* — Scherrer Patent & Trademark Law, P.C.; Stephen T. Scherrer; Monique A. Morneault

(57) ABSTRACT

A rail cant measurement tool and associated methods enable users to measure rail cant. The measurement tool comprises a reference assembly, and a cant angle measurement assembly. The reference assembly comprises a track plane reference bar. The cant angle measurement assembly comprises a web-engaging arm assembly, a spring-biased lock-release mechanism, a rail cant indicator, and a rail cant linear adjustment mechanism. The web-engaging arm assembly comprises pivot arms and web rollers. The pivot arms each comprise upper arm ends and lower arm ends. The upper arm ends are attached to the lock-release mechanism. The reference bar engages opposed rails and the cant angle measurement assembly engages a select rail of the opposed rails. The rail cant indicator indicates rail cant information as determined from the track reference plane and the running surface of the select rail.

20 Claims, 15 Drawing Sheets

13
35
52
101
34
30
44
47

13
35
51
34
30
44
46

13
35
50
34
30
44
45

100
53

RAIL CANT MEASUREMENT TOOL AND METHOD

PRIOR HISTORY

This application claims the benefit of U.S. Provisional Patent Application No. 61/573,818, filed in the United States Patent and Trademark Office on 13 Sep. 2011.

BACKGROUND OF THE INVENTION

1. Field of the Invention

The present invention relates generally to a measurement tool for use in the rail industry. More particularly, the present invention relates to a measurement tool for measuring the cant of rail, or a rail cant measurement tool.

2. Brief Description of the Prior Art

Rail cant is measured relative to the plane established by the top of the adjacent rails in track. Rail is typically installed in track on an inward inclination of 1:40 (1.43 degrees) for the purpose of best wheel-to-rail contact. Over time, track degrades because of train loadings, and thus the inclination of the rail readily changes due to various causes stemming from said loadings. In other words, rail cant can change, either inward or outward with the passing of train traffic.

Track measurement vehicles, known as geometry cars, commonly measure existing rail cant and have capability to identify variation from design. These geometry cars use optical measurement systems that have been calibrated to report rail cant accurately. Rail cant exceptions (variation from design beyond defined thresholds) are reported by location and magnitude so that track repair crews can make maintenance corrections.

Track maintenance crews need rugged, easy to use measurement tools to manually measure track and rail condition as they do their maintenance work. No tool currently exists to measure rail cant (relative to top of track plane). Therefore, track crews do not have a simple and accurate means to confirm rail cant variation or design exceptions.

The rail cant measurement tool according to the present specifications is designed to provide accurate measurement of existing rail cant, as summarized in more detail hereinafter.

SUMMARY OF THE INVENTION

As noted hereinabove, rail cant is defined as the angle made between the vertical rail centerline with track-plane as defined by a straight edge laid across the track. Since tie-plates are typically 1:40 angle or 1.43 degrees, the normal cant of each rail will be 1.43 degrees toward the center of the track.

Positive cant is defined as cant angle toward the center of the track from vertical. Vertical cant is defined as zero degree cant (absolute). Negative cant is defined as cant angle toward the field side of the track from vertical (absolute). Relative cant is defined as any deviation from normal cant. Normal relative cant is zero degrees. Normal absolute cant is 1.43 degrees. Negative cant is cant angle toward the field whether absolute or relative. Positive cant is cant angle toward the center of the track whether absolute or relative.

It is desirable to have a hand tool that can easily and accurately measure rail cant since this measurement has become important in track maintenance activities for the prevention of expensive and dangerous derailments. The value in preventing derailments is measured in lives lost or people injured and property damage in the millions of dollars. Railroads are typically self insured for the first million or two and even minor derailments can easily cost that much.

The rail cant measurement tool, according to the present invention essentially comprises a track plane reference bar optionally outfitted with certain track cross-level indicator means, and at least one cant angle measurement assembly. Each clamp cant angle measurement assembly preferably comprises certain fillet radius reference rollers, certain fillet radius reference roller links, certain pivot arms, web clamp actuation bars, a web clamp lock-release mechanism, rail cant indicating means, and certain linear slide bearing means.

To use the rail cant measurement tool according to the present invention, the user first identifies a target section of track or target track section. The rail cant measurement tool may then be aligned with the target track section and configured such that the cant angle measurement assembly is in an open configuration for accepting the rail head. The lock-release assembly must be in a clamped or actuated or compressed spring configuration so as to expand the arms and web rollers for receiving the rail head.

The uppermost portions or contact points of the rail head contacting the track reference bar or beam define a plane across the top of the rails, namely, the track reference plane. The track reference bar is seated or rested upon the opposed rails such that the contact points provide or establish the track reference plane.

Once the roller end of the cant angle measurement assembly receives the rail head, and the web rollers are positioned adjacent the rail web, the lock-release assembly can be released allowing the compression spring to expand under restorative forces to a more relaxed spring configuration thereby forcing the blocks and actuator bars in opposite directions. The arms accordingly pivot about pivot axes thereby narrowing the space between web-opposed web rollers, and closing the roller end of the cant angle measurement assembly upon the rail web.

When the cant angle measurement assembly is clamped upon one section of rail, the compression spring in combination with the symmetric actuator arms and web rollers maintain the entire clamped cant angle measurement assembly collinear with the rail vertical center line of the transverse rail cross section.

The head of the cant angle measurement assembly rotates relative to the track reference bar through the action of a rotational bearing mounted on shaft that extrudes through the track reference bar. Linear slide bearings allow the clamp head to move bi-directionally relative to the rail vertical center line for use on differing rail gauges.

The web rollers may preferably engage upper and lower fillet radii respectively situated intermediate the rail web and the rail head, and the rail web and the rail foot. In this regard, it is contemplated that the series of web rollers may preferably have certain roller radii. The roller radii and fillet radii are substantially equal in magnitude such that when the rollers engage the upper fillets and lower fillets, the substantially equal roller and fillet radii and function to enhance device attachment to the rail.

While the track reference bar maintains contact with the uppermost contact points of the opposed rails, the device-to-rail seat assembly will align itself with the vertical center line of the rail section on which the cant angle measurement assembly is clamped. The rotary encoder measures the angle of the running surface plane relative the track reference plane for measuring and outputting rail cant information.

In other words, the cant angle is preferably measured by the rotary encoder as the angle between the straight edge of the track plane reference bar and the line perpendicular to the rail vertical center line. Rail cant may be indicated directly or relative to the track cross-level. Notably, if the rail cant is indicated relative to the track cross-level, a calculation must be made to determine cant for each rail.

To remove the device, the lock-release assembly is engaged and actuated so as to compress the compression spring, spread the clamp arms, and displace the web rollers away from one another so as to enable removal of the roller end of the cant angle measurement assembly from the target track section. A handle structure may be attached to the track reference arm for ease of installation and removal of the rail cant measurement tool at a select target track section.

The rail cant measurement tool according to the present invention thus enables rail maintenance crews to quickly and easily ascertain rail cant information at any given target track section. The rail cant measurement tool, however, in addition to providing new and useful structural improvements to this particular field of art, is believed to further support certain inherent methodology. In other words, certain methodology inherently supported by the rail cant measurement tool is further contemplated to fall within the ambit of the following specifications.

BRIEF DESCRIPTION OF THE DRAWINGS

Other features of our invention will become more evident from a consideration of the following brief descriptions of illustrations of the subject invention:

FIG. 16(*a*) is an enlarged, fragmentary section of the diagrammatic depiction otherwise presented in FIG. 16 presented to more clearly depict correspondingly similar web roller and fillet radii.

DETAILED DESCRIPTION OF THE PREFERRED EMBODIMENT AND METHODOLOGY

Figure 1:
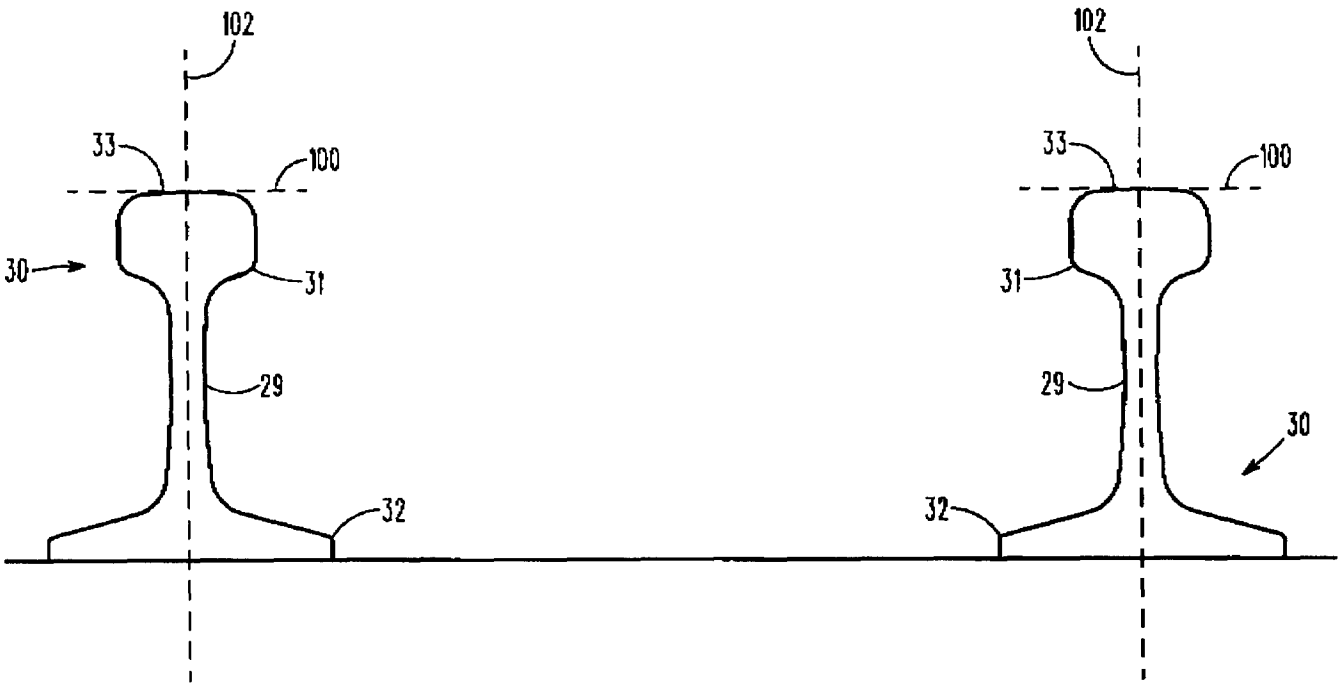
FIG. 1 is a first diagrammatic depiction of parallel, transverse rail sections depicted with zero degree or absolute rail cant depicting the rail vertical center lines and running surface planes of the rail sections.

Referring now to the drawings with more specificity, the preferred embodiment of the present invention provides a rail cant measurement tool as at 10 for measuring rail cant. Rail cant may be defined as the angle 105 made between the running surface plane 100 (which plane 100 is ideally perpendicular to the vertical rail centerline 102) and the track reference plane as at 101 or the angle 105 between the vertical rail centerline 102 and the plane 103 perpendicular or normal to the track reference plane 101.

Figure 3:
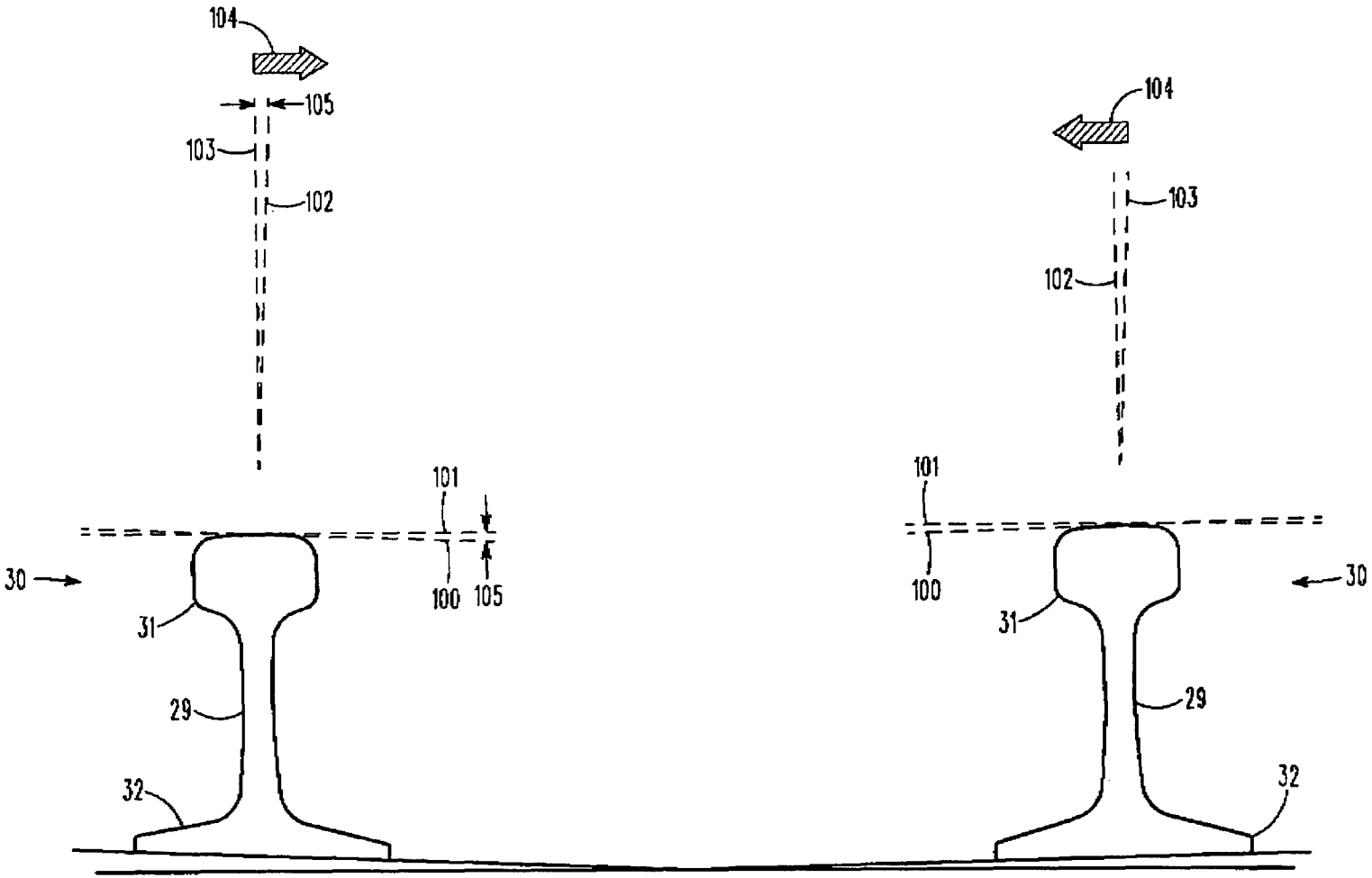
FIG. 3 is a diagrammatic depiction of parallel, transverse rail sections depicted with positive rail cant.

The track reference plane 101 may be most easily determined by providing a straight edge, and laying the same straight edge across a target track section. Since tie-plates are typically 1:40 angle or 1.43 degrees, the normal cant of each rail will be 1.43 degrees toward (as at vector 104) the center of the target track section. Positive cant is preferably defined as cant angle toward (as at vector 104) the center of the track from vertical as is generally depicted in FIG. 3.

Figure 2:
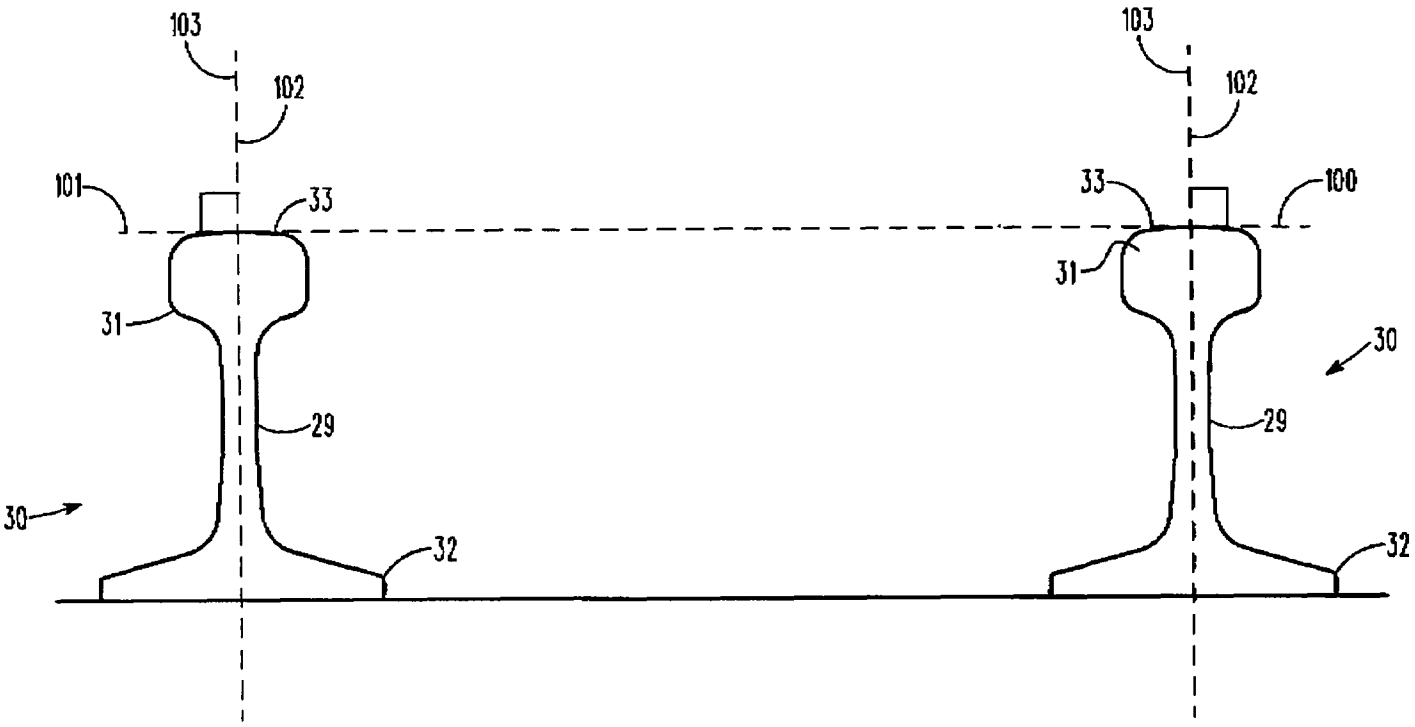
FIG. 2 is a second diagrammatic depiction of parallel, transverse rail sections depicted with zero degree or absolute rail cant depicting the rail vertical center lines and running surface planes of the rail sections, as well as a track reference plane coplanar with the running surface plans and planes orthogonal to the track reference plane and coplanar with the rail vertical center lines.
Figure 4:
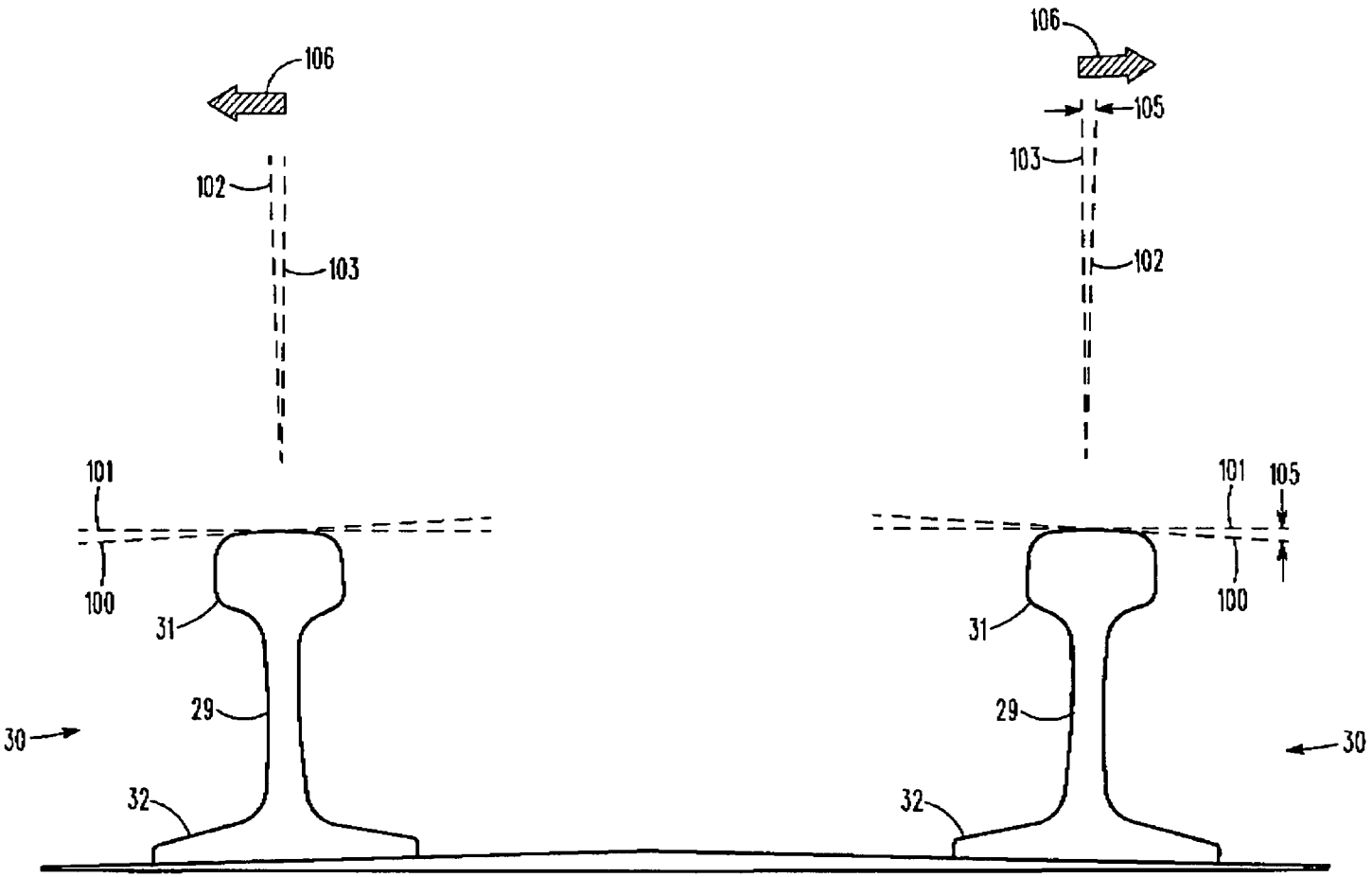
FIG. 4 is a diagrammatic depiction of parallel, transverse rail sections depicted with negative rail cant.

Vertical or absolute cant is preferably defined as zero degree cant as is generally depicted in FIGS. 1 and 2. Negative cant is preferably defined as cant angle toward (as at vector 106) the field side of the target track section from vertical as is generally depicted in FIG. 4. Relative cant is defined as any deviation from normal cant. Normal relative cant is zero degrees. Normal absolute cant is 1.43 degrees. Negative cant is cant angle toward the field whether absolute or relative. Positive cant is cant angle toward the center of the track whether absolute or relative.

As has been noted, it is highly desirable to provide a hand tool that can easily and accurately measure rail cant since this measurement has become important in track maintenance activities for the prevention of expensive and dangerous derailments. The value in preventing derailments is measured in lives lost or people injured and property damage in the millions of U.S. dollars. Railroads are typically self insured for the first million or two and even minor derailments can easily cost that much.

Accordingly, to achieve the primary objective of providing a rail cant measurement tool, and other readily apparent objectives, the rail cant measurement tool 10 according to the present invention essentially comprises certain plane-determination means for determining the track reference plane 101, and certain cant-determination means for determining the cant angle 105 relative to the track reference plane 101. The plane-determination means may be preferably exemplified by a track plane reference assembly, and the cant-determination means may be preferably exemplified by a cant angle measurement device or mechanism according to the present invention.

The track plane reference assembly according to the present invention preferably comprises a track plane reference bar or beam as at 11, which track plane reference bar or beam 11 may be preferably outfitted with certain track cross-level indicator means as at 12. As may be seen from an inspection of FIGS. 5 and 6, the track plane reference bar 11 essentially provides a straight edge as at 40 for defining a track reference plane 101.

The track reference plane may thus be determined from the straight edge 40 placed atop the uppermost portions of opposed rail heads 31 however inclined from vertical the vertical center line 102 may be. The straight edge 40 may thus rest atop the running surface 33 or upper edging of the rail head 31 adjacent the running surface 33 depending on the degree of rail cant 105.

As stated, the track plane reference bar or member 11, in combination with the track cross-level indicating means 12, together may be viewed as a preferred track plane reference assembly according to the present invention. It is contemplated that the track cross-level indicating means 12 according to the present invention may be exemplified by indicators of either mechanical or electrical design.

Conceivably, gravity operated linkages can operate mechanical indicators with expanded scale for easy reading. Further, it is contemplated that micro-electromechanical system (MEMS) type inclinometers may be used with microcontrollers, microprocessors, PIC chips or any other suitable embedded processing device in order to calibrate and calculate track cross-level.

On tangent track, it is typical and correct that both rails 30 must have the same elevation. In other words, an imaginary line at right angles to the two rails 30 connecting their tops must be level or horizontal. Curved track, however, is typically and correctly banked; the outside first rail 30 being raised relative to the inside second rail 30. The condition of cross level where one of the two rails 30 is purposely raised is known as superelevation. The track cross-level indicating means 12 essentially function to generally indicate the degree of superelevation of the first rail 30 relative to the second rail 30.

The cant-determination means is preferably exemplified by at least one cant angle measurement device or assembly 13 cooperably and structurally associated with the track reference bar 11. In this regard a shaft 14 of the cant angle measurement device 13 is extruded through the track reference bar 11 and rotary or rotational bearing(s) as at 15 is/are mounted on or to the shaft 14 for enabling rotation of the shaft 14 and track reference bar 11 relative to plates 43. The head of the operative cant angle measurement device or mechanism 13 is thus made rotational relative to the track reference bar 11 by way of the rotational bearing(s) 15 and shaft 14. The shaft 14 and bearing(s) 15 may thus exemplify certain means for movably coupling the cant angle measurement assembly 13 to the track plane reference bar 11.

Each cant angle measurement device 13 may be further said to preferably a web-engaging arm assembly or assemblies as at 34; the spring-biased lock-release assembly as at 35; certain rail cant information measuring/outputting means as preferably exemplified by a rotary encoder mechanism as at 36; and certain linear slide bearing means as preferably exemplified by a series of linear slide bearing assemblies as referenced at 37.

The web-engaging arm assembly 34 preferably comprises eight web reference rollers as at 16; two V-shaped web reference roller links as at 17; four pivot arms as at 18; and two web clamp actuation bars as at 19. The pivot arms 18 each comprise upper arm ends 20, and lower arm ends 21. The upper arm ends 20 are attached to the spring-biased lock-release assembly 35 via the actuation bars 19 at the anterior or front side 38 and attached directly to the lock-release assembly 35 at the posterior or rear side 39 of the device 13.

In this regard, the lock-release assembly 35 preferably comprises a compression spring as at 22, opposed force transmission blocks as at 41, and handle-based means as at 42 for selectively compressing and releasing the compression spring 22 for respectively opening (via spring compression) and closing (via spring release) the device 13. The arm-clamping or closing forces are directed into the arms 18 via the bars 19 and blocks 41, and forced action of the spring-biased lock-release assembly 35 when the lock-release assembly 35 is released and the compression spring 22 returns to a more relaxed spring state.

The V-shaped web reference roller links 17 each preferably comprise a vertex or pin end 23 and a roller end 24. The pin ends 23 are preferably connected by way of a hinge pin as at 25, which hinge pins 25 each have a pin axis as at 107. The rollers 16 are attached to the roller ends 24 of the roller links 17, and have axes of rotation as at 108 parallel to the pin axes 107. The hinge pins 25 are each preferably outfitted with torsion springs 26, which springs 26 cooperably interact with spring stop structures 27 and spring-receiving windows 28 formed in the vertex end or pin ends 24 of the roller links 17. It is contemplated that the torsion springs 26 enhance alignment of the rollers 16 and roller links 17 relative to the rail web 29 of a rail 30 for increasing the accuracy of output measured information indicative of rail cant angle 105.

The cant angle measurement device 13 essentially functions to clamp-engage a rail 30 of a target rail section. The rollers 16 engage the rail web 29 intermediate the rail head 31 and the rail foot 32 when the lock-release assembly 35 is released and the compression spring 22 returns under restorative forces to a more relaxed spring state.

Linear slide mounting plates 43 connected to the linear slide bearings 37 seat or rest upon the running surface 33 of the rail head 31 at the target track section and enable bi-directional (e.g. vertical) movement of the device-to-rail seat assembly (comprising the linear slide mounting plates 43, linear slide bearings 37, rotary encoder 36, and rotary encoder cover 44) along the vertical center line 102.

It should be noted that the coupled shaft 14 and arm 11 combination rotates relative to the linear slide mounting plates 43 so that the bottom straight edge 56 of the plates 43 seat or rest upon the (substantially planar) running surface 33 of the select rail head 31 while the bottom straight edge of the arm 11 rests upon the uppermost portion of the select rail head 31.

Recalling that the running surface 33 essentially defines the running surface plane 100, the track reference bar and cant angle measurement device or assembly 13 together essentially function to measure and output rail cant information reflective of the cant angle 105 intermediate the running surface plane 100 and the track reference plane 101 as defined by the bottom straight edge 40 of the track reference bar 11.

Figure 5:
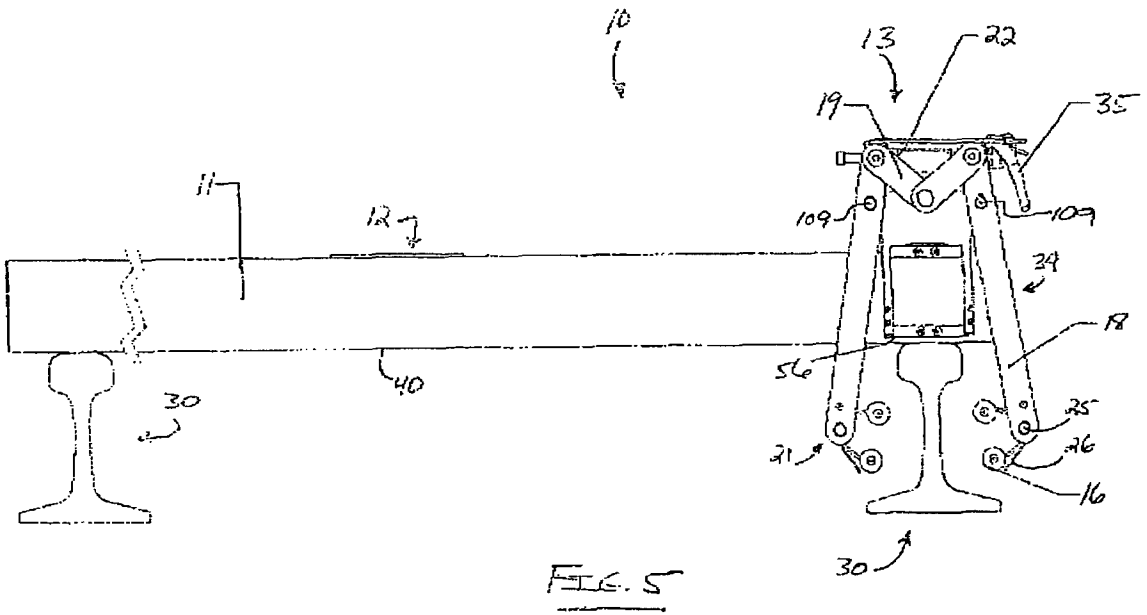
FIG. 5 is an anterior or frontal view of the rail cant measurement tool according to the present invention with the track plane reference assembly shown placed across parallel, transverse rail sections depicted with absolute cant with the cant angle measurement assembly in a rail-received open configuration prior to clamped engagement with the right most rail section.

To use the rail cant measurement tool 10, the user first identifies a target section of track or target track section. The rail cant measurement tool 10 may then be aligned with the target track section and configured such that the cant angle measurement assembly 13 is in an open configuration for accepting the rail head 31 as generally depicted in FIG. 5. The lock-release assembly 35 must be in a clamped or actuated or compressed spring configuration so as to expand the arms 18 and rollers 16 for receiving the rail head 31.

The uppermost portions or contact points of the rail head contacting the track reference bar or beam 11 define a plane across the top of the rails 30, namely, the track reference plane 101. The track reference bar 11 is seated or rested upon the opposed rails 30 such that the contact points provide or establish the track reference plane 101 as further generally depicted in FIGS. 5 and 6.

Once the roller end of the cant angle measurement assembly 13 receives the rail head 31, and the web rollers 16 are positioned adjacent the rail web 29, the lock-release assembly 35 can be released allowing the compression spring 22 to expand under restorative forces to a more relaxed spring configuration thereby forcing the blocks 41 and actuator bars 19 in opposite directions. The arms 18 accordingly pivot about axes 109 thereby narrowing the space between web-opposed web rollers 16, and closing the roller end of the cant angle measurement assembly 13 upon the rail web 29.

When the cant angle measurement assembly 13 is clamped upon one section of rail 30, the compression spring 22 in combination with the symmetric actuator arms 19 and web rollers 16 maintain the entire clamped cant angle measurement assembly 13 collinear (as at box 110) with the rail vertical center line 102 of the transverse rail cross section.

The head (as at box 110) of the cant angle measurement assembly 13 rotates relative to the track reference bar 11 through the action of a rotational bearing as at 15 mounted on shaft 14 that extrudes through the track reference bar 11. Linear slide bearings 37 allow the clamp head to move bi-directionally relative to the rail vertical center line 102 for use on differing rail gauges as generally and comparatively depicted in FIGS. 13-15.

Figures 13, 14, 15:
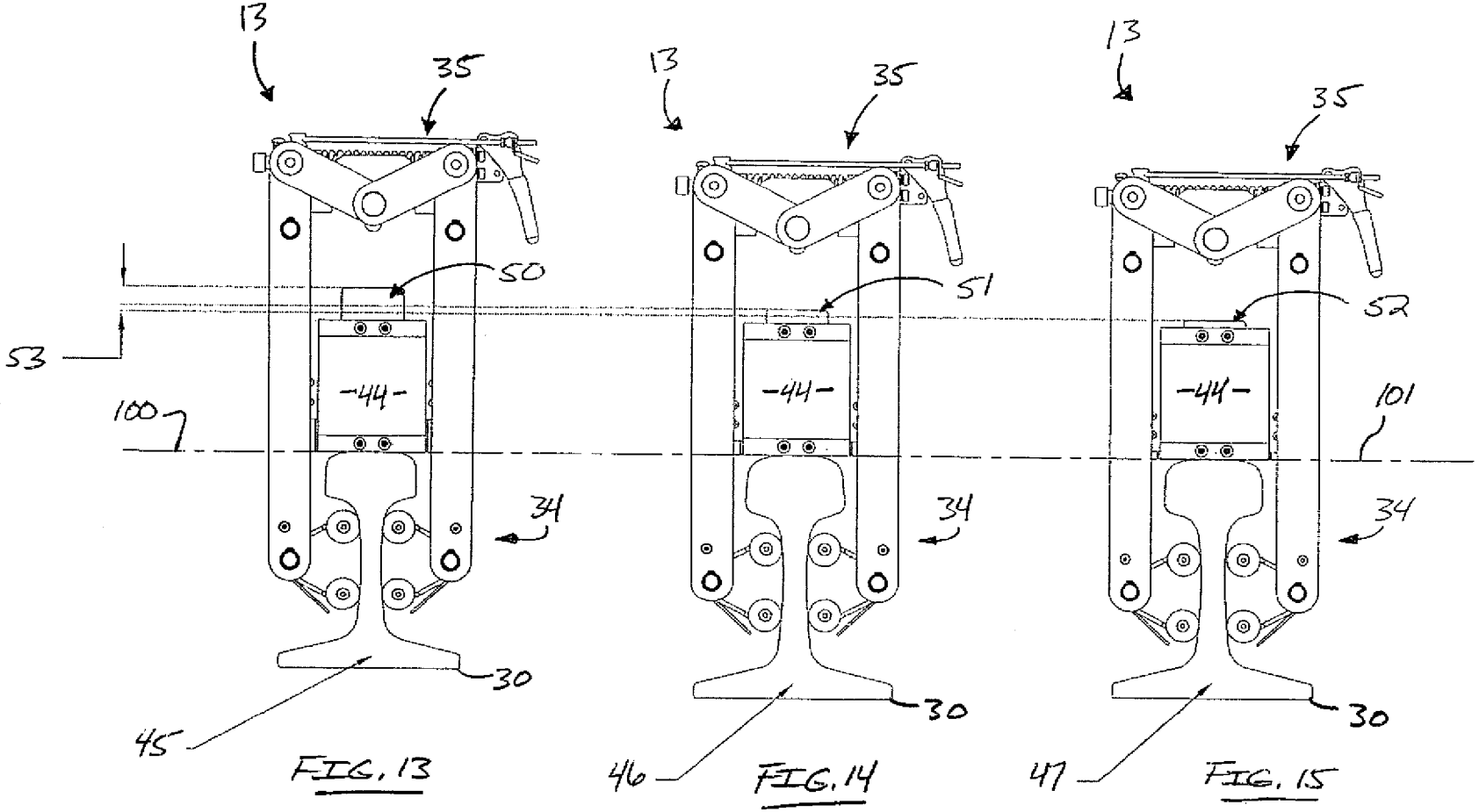
FIG. 13 is a first anterior or frontal view of the cant angle measurement assembly according to the present invention shown in a rail-received clamped configuration with a first rail having a first rail gauge in engagement therewith, the linear slide bearing means of the cant angle measurement assembly enabling or providing a comparative maximum downward displacement of the rotary encoder assembly.
FIG. 14 is a second anterior or frontal view of the cant angle measurement assembly according to the present invention shown in a rail-received clamped configuration with a second rail having a second rail gauge in engagement therewith, the linear slide bearing means of the cant angle measurement assembly enabling or providing a comparatively medium downward displacement of the rotary encoder assembly as compared to the downward displacements depicted in FIGS. 13 and 15.
FIG. 15 is a third anterior or frontal view of the cant angle measurement assembly according to the present invention shown in a rail-received clamped configuration with a third rail having a third rail gauge in engagement therewith, the linear slide bearing means of the cant angle measurement assembly enabling or providing a comparative minimum downward displacement of the rotary encoder assembly.

FIG. 13, for example, depicts the cant angle measurement assembly 13 clamped or outfitted upon 115 pound rail as at 45 showing a maximum vertical gap 50 (or maximum downward vertical displacement) enabled by way of the linear slide bearings 37. FIG. 14 comparatively depicts the cant angle measurement assembly 13 clamped or outfitted upon 141 pound rail as at 46 showing a medium vertical gap 51.

Finally, FIG. 15 depicts the cant angle measurement assembly 13 clamped or outfitted upon 136 pound rail as at 47 showing a minimum vertical gap 52 (or minimum downward vertical displacement). Exemplary degrees of the linear slide motion for the three illustrated and differing rail types are generally illustrated and comparatively depicted at 53.

The web rollers 16 may preferably engage upper and lower fillet radii as at 111 respectively situated intermediate the rail web 29 and the rail head 31, and the rail web 29 and the rail foot 32. In this regard, it is contemplated that the series of web rollers 16 may preferably have certain roller radii as at 112.

Figures 16, 16A:
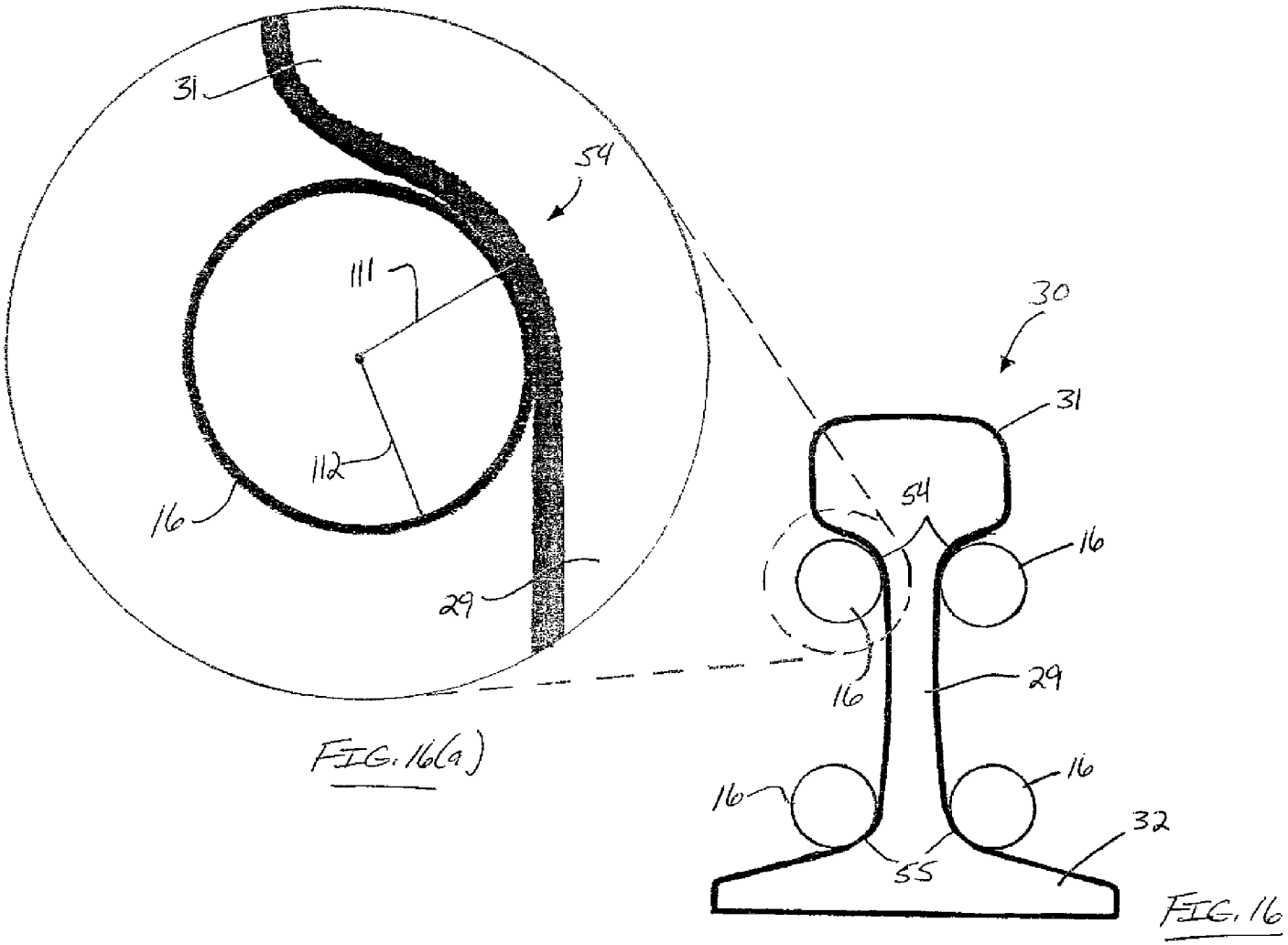
FIG. 16 is a diagrammatic depiction of a transverse section of rail shown outfitted with unsupported rollers to demonstrate for the reader where the web rollers according to the present invention may preferably engage the web-head fillets and web-foot fillets of the rail.
Figure 19:
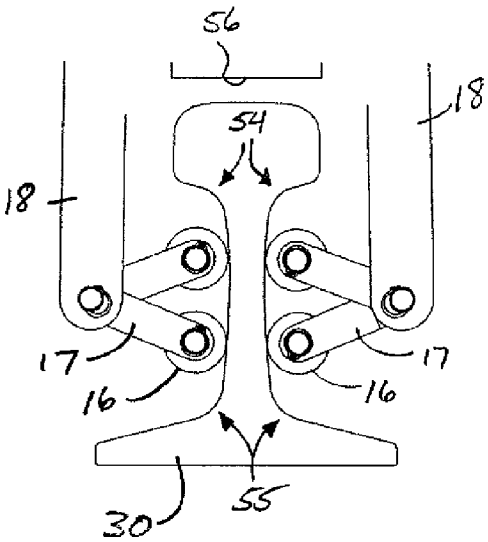
FIG. 19 is a third anterior or frontal fragmentary view of the cant angle measurement assembly according to the present invention shown in a rail-received clamped configuration with a third rail wherein the web rollers are alternatively engaged with second portions of the rail web for enhancing assembly-to-web engagement and accuracy of rail cant measurements.
Figure 18:
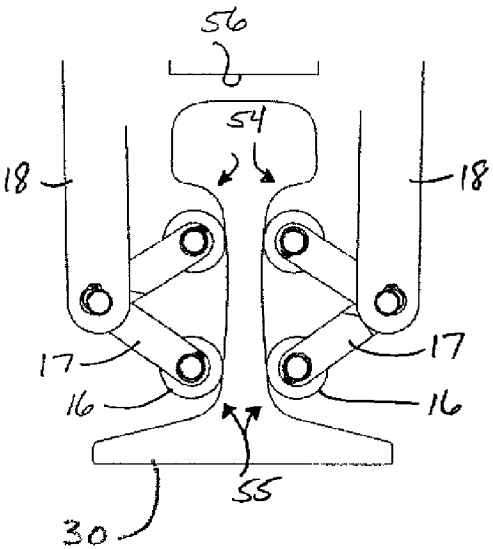
FIG. 18 is a second anterior or frontal fragmentary view of the cant angle measurement assembly according to the present invention shown in a rail-received clamped configuration with a second rail wherein the web rollers are alternatively engaged with first portions of the rail web for enhancing assembly-to-web engagement and accuracy of rail cant measurements.
Figure 17:
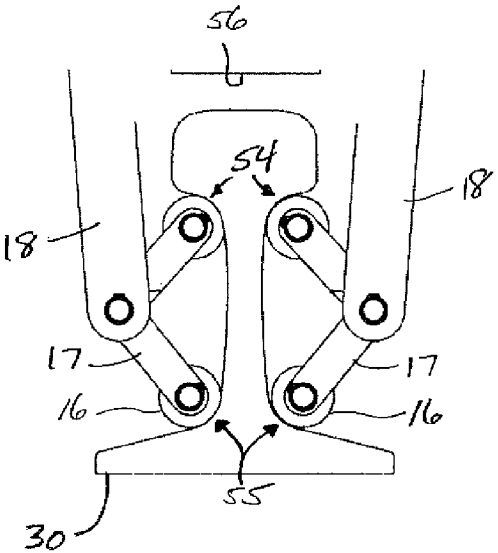
FIG. 17 is a first anterior or frontal fragmentary view of the cant angle measurement assembly according to the present invention shown in a rail-received clamped configuration with a first rail wherein the web rollers are preferably engaged with head-to-web fillets and foot-to-web fillets for enhancing assembly-to-web engagement and accuracy of rail cant measurements.

From an inspection of FIG. 16(*a*), for example, it will be seen that the roller radii 112 and fillet radii 111 are substantially equal in magnitude such that when the rollers 16 engage the upper fillets 54 and lower fillets 55, the substantially equal roller and fillet radii 112 and 111 function to enhance device attachment to the rail 30.

Figure 6:
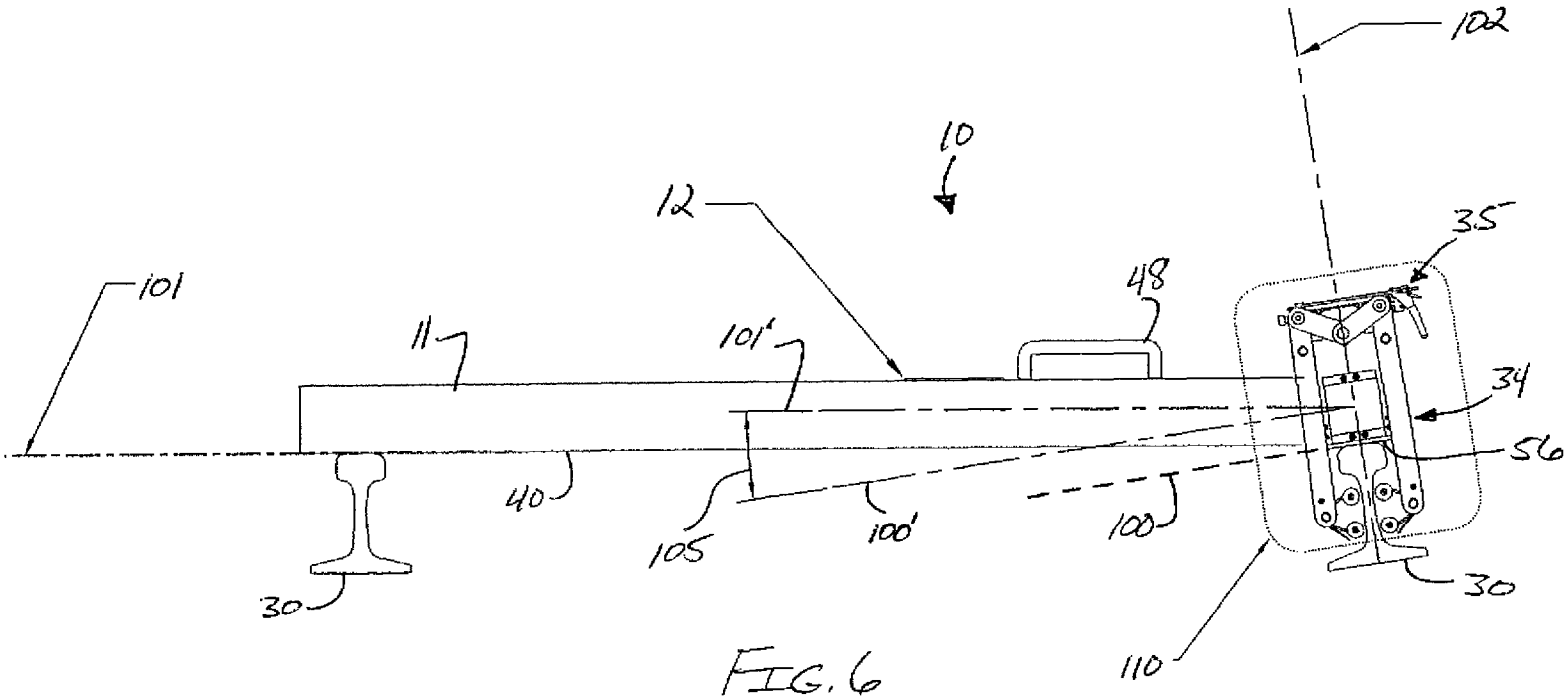
FIG. 6 is an anterior or frontal view of the rail cant measurement tool according to the present invention with the track plane reference assembly shown placed across parallel, transverse rail sections depicted with varied rail cant with the cant angle measurement assembly in a rail-received closed configuration after clamped engagement with the right most rail section.
Figure 7:
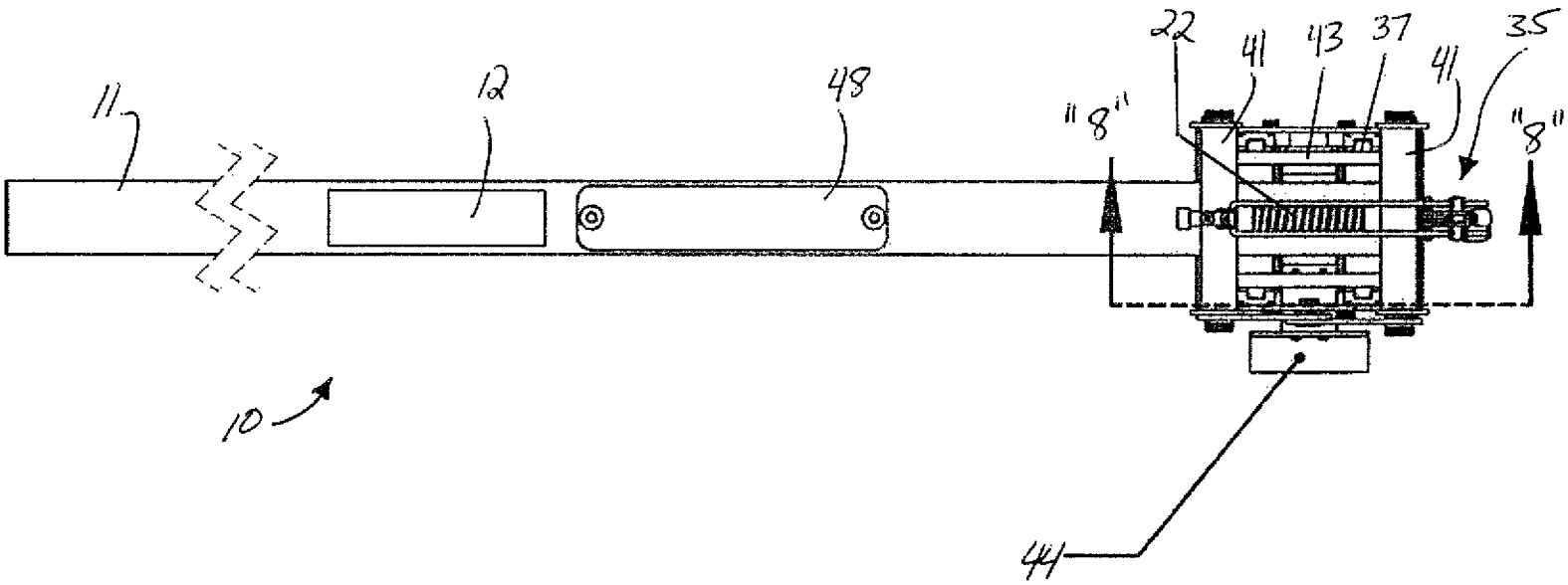
FIG. 7 is a top plan type view of the rail cant measurement tool according to the present invention showing the track reference bar of the track plane reference assembly with a break therein to depict an abbreviated track reference bar for ease of illustration and clarity.
Figure 8:
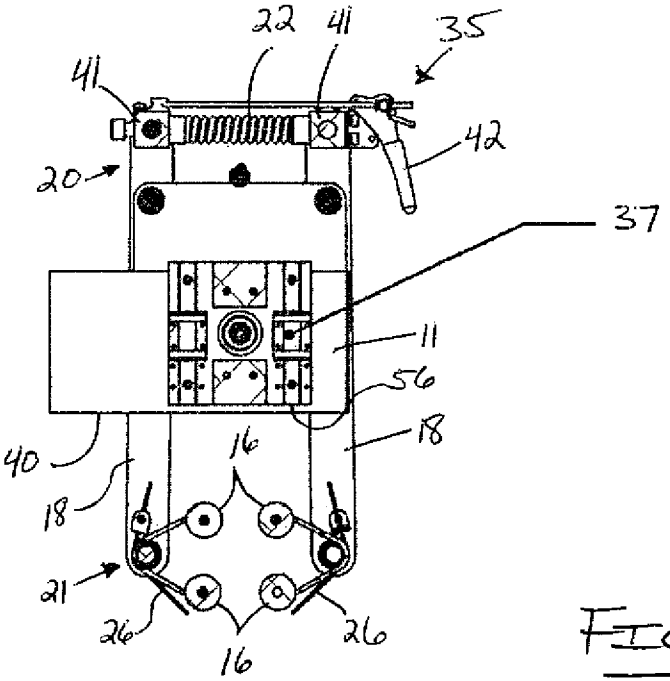
FIG. 8 is a fragmentary sectional view of the rail cant measurement tool according to the present invention as sectioned from FIG. 7 to primarily depict portions of the cant angle measurement assembly.
Figure 9:
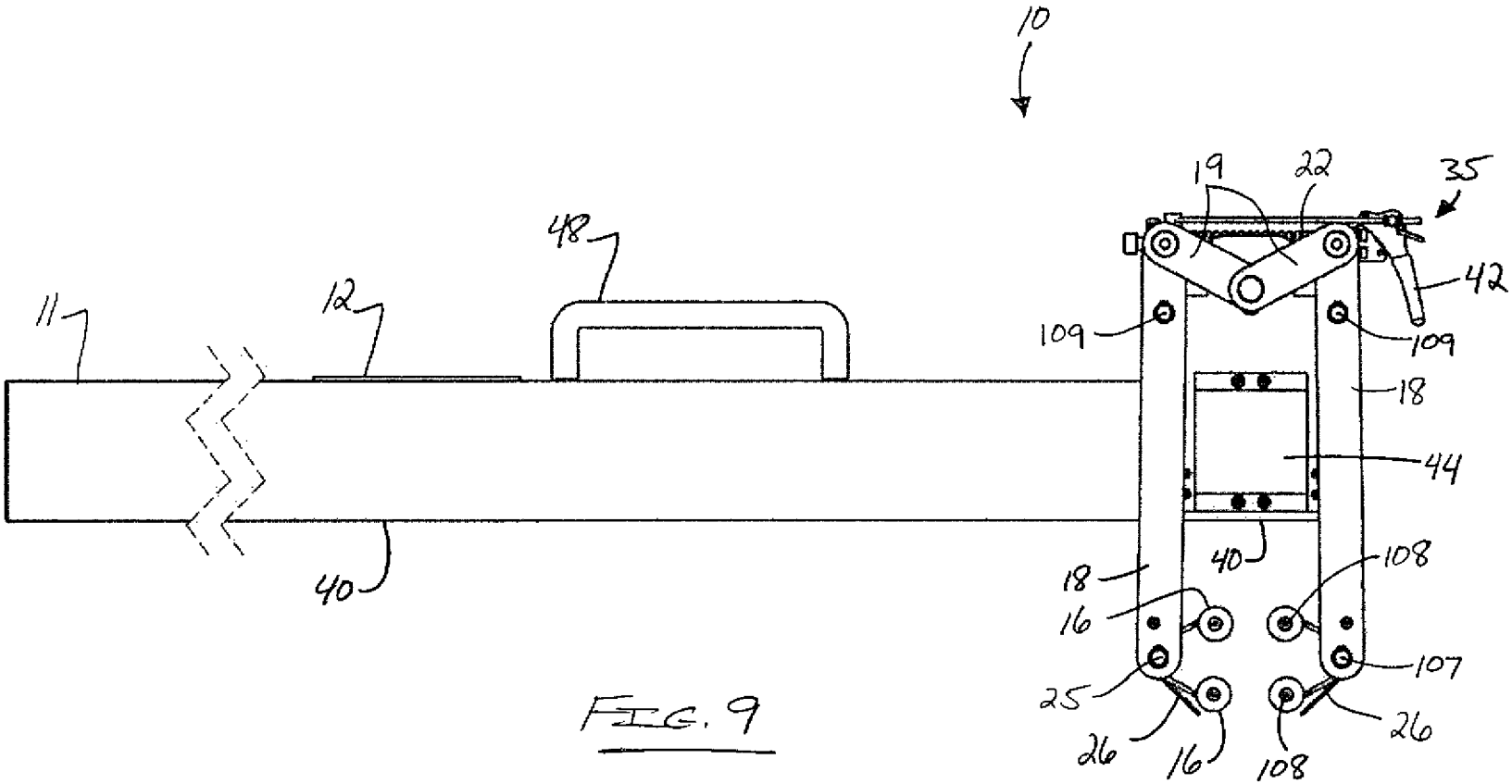
FIG. 9 is an anterior or frontal view of the rail cant measurement tool according to the present invention showing the track plane reference assembly and the cant angle measurement assembly in a closed configuration.
Figure 10:
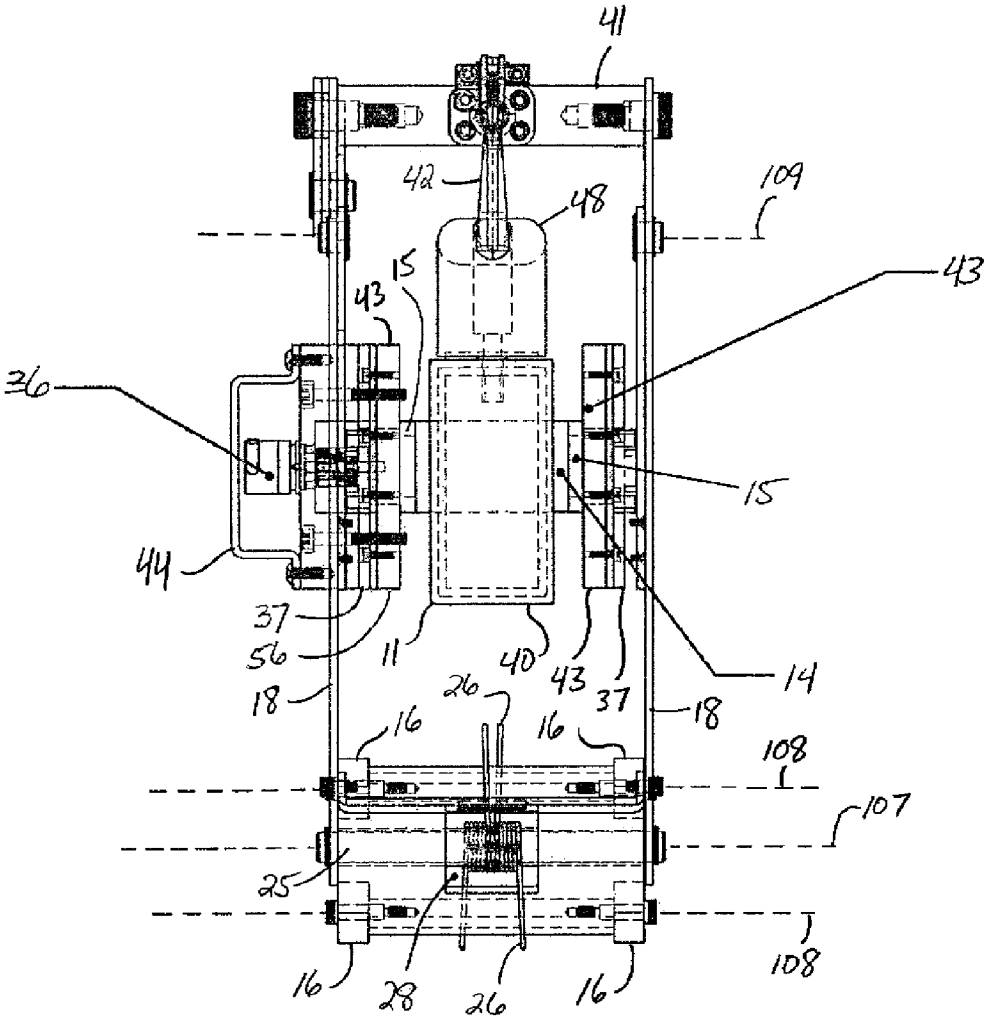
FIG. 10 is an end view of the rail cant measurement tool according to the present invention showing the track reference bar and the cant angle measurement assembly coupled by way of a bearing mounted shaft extruded through the track reference bar.
Figure 11:
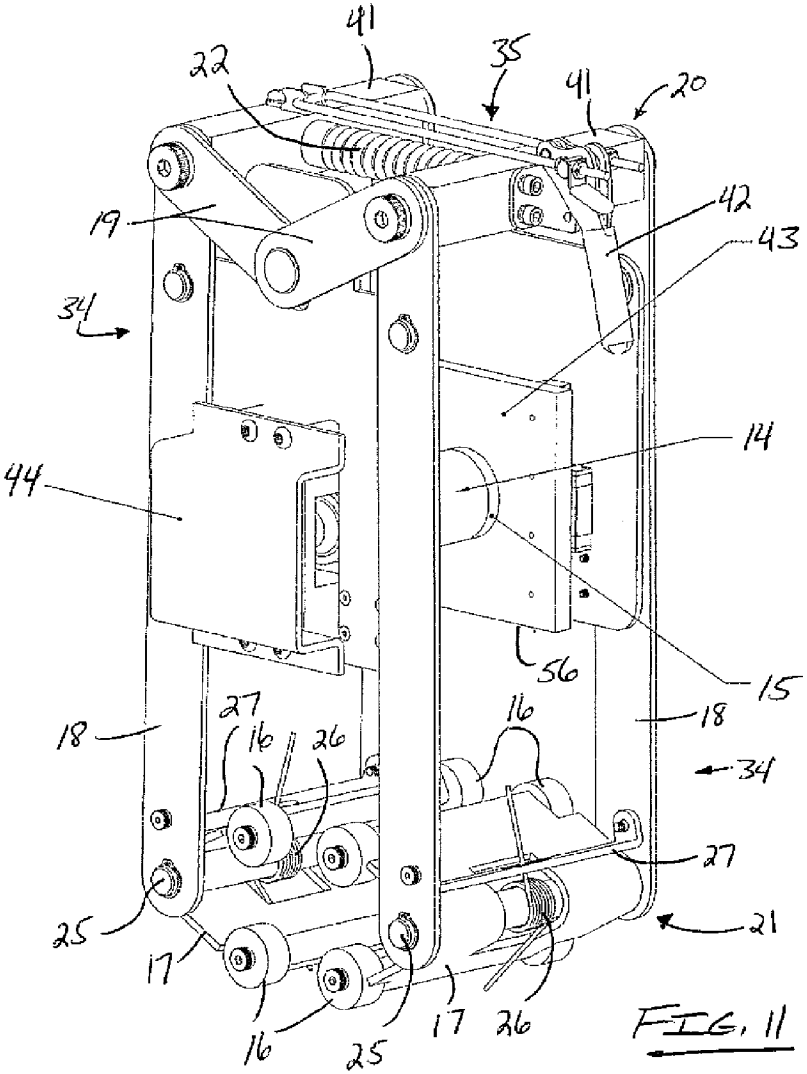
FIG. 11 is a top perspective view of the cant angle measurement assembly according to the present invention shown in an assembled closed configuration.
Figure 12:
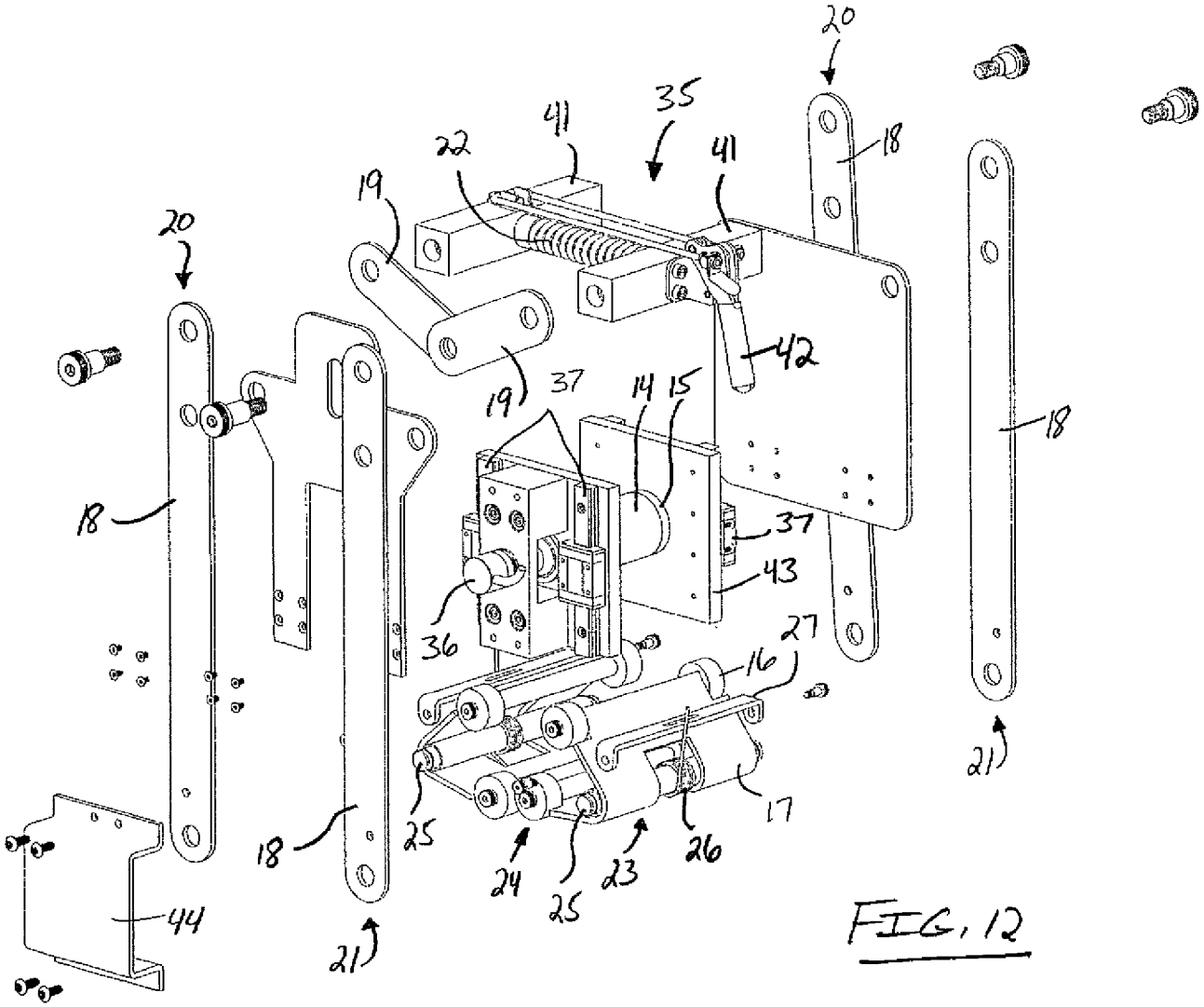
FIG. 12 is an exploded top perspective view of the cant angle measurement assembly according to the present invention, inclusive of numerous fasteners for assembling the cant angle measurement assembly.

While the track reference bar 11 maintains contact with the uppermost contact points of the opposed rails 30, the device-to-rail seat assembly will align itself with the vertical center line 102 of the rail section on which the cant angle measurement assembly 13 is clamped. The rotary encoder 36 measures the angle of the running surface plane 100 relative the track reference plane 101 for measuring and outputting rail cant information. FIG. 6 depicts the cant angle as measured from the site of the rotary encoder 36 showing plane 101' parallel to track reference plane 101 and plane 100' parallel to running surface plane 100.

In other words, the cant angle 105 is preferably measured by the rotary encoder 36 as the angle between the straight edge 40 of the track plane reference bar 11 and the line (or plane 100) perpendicular to the rail vertical center line 102. Rail cant may be indicated directly or relative to the track cross-level. Notably, if the rail cant is indicated relative to the track cross-level, a calculation must be made to determine cant for each rail.

To remove the device, the lock-release assembly 35 is engaged and actuated so as to compress the compression spring 22, spread the clamp arms 18, and displace the web rollers 16 away from one another so as to enable removal of the roller end of the cant angle measurement assembly 13 from the target track section. A handle structure as at 48 may be attached to the track reference arm 11 for ease of installation and removal of the rail cant measurement tool 10 at a select target track section.

The rail cant measurement tool 10 according to the present invention thus enables rail maintenance crews to quickly and easily ascertain rail cant information at any given target track section. The rail cant measurement tool 10, however, in addition to providing new and useful structural improvements to this particular field of art, is believed to further support certain inherent methodology. In other words, certain methodology inherently supported by the rail cant measurement tool is further contemplated to fall within the purview of the foregoing specifications.

For example, it is further contemplated that the present specifications support a method for measuring rail cant, which method comprises a series of steps, including the initial provision of a rail cant measurement tool, and the subsequent application of that tool 10 by engaging a select rail section of a select target track section via the cant angle measurement assembly 13 and track reference assembly of the rail cant measurement tool 10 according to the present invention.

When the rail cant measurement tool 10 is attached to the rail 30 or target rail section, the web rollers 16 thereby may engage upper and lower fillet radii (as at 111) respectively situated intermediate the rail web 29 and rail head 31, and the rail web 29 and rail foot 32. Once the rail cant measurement tool 10 is engaged with the target track section, certain track cross-level information can be read or ascertained via the cross level indicating means 12, and certain rail cant information can be read or ascertained via the rail cant indicating means or cant-determination means. The rail cant information may be optionally determined relative to the track cross-level information.

Stated another way, the present invention may be said to support a method for measuring rail cant, whereby a target track section is initially identified, which track section comprises opposed, parallel rail portions 30. Each rail portion 30 comprises a rail head 31, a rail foot 32, and a rail web 29 extending intermediate the rail head 31 and rail foot 32. The rail head to rail web junction site comprises an upper rail fillet as at 54, and the rail foot to rail web junction site comprises a lower rail fillet as at 55.

A device such as that exemplified by cant angle measurement assembly 13 may then be removably attached (or clamped) to a select rail portion 22, which cant angle measurement assembly 13 is pre-outfitted with certain rail cant indicating or cant-determination means, and which cant angle measurement assembly 13 is interconnected with a cross-member (as at 11), which cross-member 11 may be outfitted with certain cross-level indicating means (as at 12). Certain track cross-level information may then be read or ascertained via the cross-level indicator means; and certain rail cant information may then be read or ascertained via the rail cant indicating means.

It is contemplated that the indicators may be either mechanical or electrical in design. Conceivably, gravity operated linkages can operate mechanical indicators with expanded scale for easy reading. Further, it is contemplated that micro-electromechanical system (MEMS) type inclinometers may be used with microcontrollers, microprocessors, PIC chips or any other suitable embedded processing device in order to calibrate and calculate individual rail cant and other track measurement parameters such as track gauge.

While the foregoing specifications set forth much specificity, the same should not be construed as setting forth limits to the invention but rather as setting forth certain preferred embodiments and features. For example, as prefaced hereinabove, it is contemplated that the present invention essentially provides a rail cant measurement tool.

The rail cant measurement tool according to the present invention essentially functions to measure rail cant and is believed to essentially comprise certain plane-determination means (e.g. an object having a straight edge) cooperable with certain cant-determination means. The plane-determination means essentially function to determine a track reference plane of a track assembly, which track assembly comprises opposed rails, each of which comprise a rail head and a rail web.

The plane-determination means are engageable with the opposed rails at uppermost portions of the rail heads, each of which comprise a substantially planar running surface. The plane-determination means may preferably comprise a track plane reference assembly comprising a track plane reference bar the lower edge of which is a straight edge engageable with the opposed rails at the uppermost portions of the rail heads for defining the track reference plane.

The cant-determination means according to the present invention essentially function to determine rail cant relative to the track reference plane. The cant-determination means are engageable with the plane-determination means and a select planar running surface. The cant-determination means according to the present invention comprise certain means for measuring and outputting rail cant information reflecting the angle of the select planar running surface relative the track reference plane.

The cant-determination means according to the present invention may preferably comprise certain clamping means for selectively and removably positioning the cant-determination means into engagement with the plane-determination means and the select planar running surface. The clamping means may preferably comprise a web-engaging (arm) assembly and certain assembly locking means as exemplified by the spring-biased lock-release assembly 35.

The web-engaging (arm) assembly essentially functions to position the cant-determination means into engagement with the plane-determination means and the select planar running surface via structural engagement with a select rail web. The web-engaging (arm) assembly preferably comprises opposed arm assemblies for engaging inner (track center side) and outer (field side) portions of the select rail web.

The opposed arm assemblies are preferably outfitted with certain roller means as exemplified by web rollers and the attendant hardware for enhancing assembly-to-web engagement of the opposed arm assemblies against the select rail web. The roller means according to the present invention preferably comprise certain spring means for enhancing alignment of the roller means during engagement with the select rail web so as to enhance the accuracy of the output measured rail cant information.

The assembly-locking means essentially function to selectively lock the web-engaging arm assembly in a web-engaging configuration, and may preferably comprise certain spring means for biasing the assembly-locking means in a head-receiving configuration as generally depicted in FIG. 5.

The cant-determination means may further preferably comprise a rotary encoder assembly and certain linear slide bearing means. The rotary encoder assembly according to the present invention is engageable with the select planar running surface for measuring and outputting the rail cant information. The linear slide bearing means essentially enable the cant-determination means to move orthogonally relative to the select planar running surface, thereby enabling tool use on varying rail gauges.

Essential methods for measuring rail cant are believed to comprise the basic steps of initially identifying a target track section comprising opposed, parallel rail portions, each rail portion comprising a rail head, a rail foot, and a rail web extending intermediate the rail head and rail foot. Certain plane-determination means may then be removably engaged with the opposed, parallel rail portions at the rail heads for determining a track reference plane of the target track section.

Certain cant-determination means are engaged or coupled with the plane-determination means and clamped upon a select rail head, which cant-determination means comprise certain information measurement and output means for measuring and outputting rail cant information as determined from the select rail head, which output measured rail cant information from the cant-determination means is received by the user.

The step of clamping the cant-determination means into engagement with the select rail head may preferably comprise the step of structurally engaging a select rail web with a web-engaging arm assembly, the web-engaging arm assembly for positioning the cant-determination means into engagement with the select rail head. The web-engaging arm assembly may preferably comprise opposed arm assemblies, however, which opposed arm assemblies engage both inner and outer portions of the select rail web when structurally engaging the same. The opposed arm assemblies may preferably be outfitted with certain roller means for enhancing assembly-to-web engagement of the opposed arm assemblies with the select rail web.

The step of engaging the select rail head via the cant-determination means may further preferably comprise the step of engaging a running surface of the select rail head with a rotary encoder assembly for measuring and outputting the rail cant information. Further, the step of engaging the running surface of the select rail head with the rotary encoder assembly comprises the step of engaging the select rail head with the rotary encoder assembly by way of certain linear slide bearing means for enabling a portion of the cant-determination means to move orthogonally relative to a portion of the plane-determination means.

Accordingly, although the invention has been described by reference to certain preferred embodiments and certain methodologies, it is not intended that the novel arrangement and methods be limited thereby, but that modifications thereof are intended to be included as falling within the broad scope and spirit of the foregoing disclosures and the appended drawings.

We claim:

1. A rail cant measurement tool for measuring rail cant, the rail cant measurement tool comprising:

a track plane reference assembly, the reference assembly comprising a track plane reference bar; and a cant angle measurement assembly, the cant angle measurement assembly comprising a web-engaging arm assembly, a lock-release assembly, rail cant indicating means, and means for movably coupling the cant angle measurement assembly to the track plane reference bar, the web-engaging arm assembly comprising opposed pivot arms, the pivot arms each comprising upper arm ends and lower arm ends, the upper arm ends being attached to the lock-release assembly, the cant angle measurement assembly for engaging a select rail, the web-engaging arm assembly for engaging a rail web of the select rail via the lower arm ends and action of the lock-release assembly, the track plane reference bar being engageable with opposed rails inclusive of the select rail for determining a track reference plane, the rail cant indicating means being engageable with a running surface of the select rail for indicating rail cant information reflective of the angle between the running surface and the track reference plane.

2. The rail cant measurement tool of claim 1 wherein the lower arm ends comprise web-rollers and the select rail comprises fillets, the rollers having roller radii, the fillets having fillet radii, the roller and fillet radii being substantially equal, the rollers being engageable with the fillets with substantially equal roller and fillet radii for enhancing device engagement with the select rail and for enhancing measured rail cant information.

3. A rail cant measurement tool for measuring rail cant, the rail cant measurement tool comprising:

plane-determination means for determining a track reference plane of a track assembly, the track assembly comprising opposed rails, each rail comprising a rail head and a rail web, the plane-determination means being engageable with the opposed rails at uppermost portions of the rail heads thereby determining the track reference plane, each rail head comprising a planar running surface; and cant-determination means for determining rail cant relative to the track reference plane, the cant-determination means being cooperable with the plane-determination means and engageable with a select planar running surface and comprising means for measuring rail cant information, the rail cant information reflecting the angle of the select planar running surface relative the track reference plane.

4. The rail cant measurement tool of claim 3 wherein the plane-determination means comprise a track plane reference assembly, the track plane reference assembly comprising a track plane reference bar, the track plane reference bar being engageable with the opposed rails at the uppermost portions of the rail heads thereby determining the track reference plane.

5. The rail cant measurement tool of claim 3 wherein the cant-determination means comprise clamping means, the clamping means for selectively and removably positioning the means for measuring rail cant information into engagement with the select planar running surface.

6. The rail cant measurement tool of claim 5 wherein the clamping means comprise a web-engaging arm assembly, the web-engaging arm assembly for positioning the means for measuring rail cant information into engagement with the select planar running surface via structural engagement with a select rail web.

7. The rail cant measurement tool of claim 6 wherein the clamping means comprise assembly-locking means for selectively locking the web-engaging arm assembly in a web-engaging configuration.

8. The rail cant measurement tool of claim 6 wherein the web-engaging assembly comprises opposed arm assemblies, the opposed arm assemblies for engaging inner and outer portions of the select rail web.

9. The rail cant measurement tool of claim 8 wherein the opposed arm assemblies are outfitted with roller means, the roller means for enhancing assembly-to-web engagement of the opposed arm assemblies with the select rail web.

10. The rail cant measurement tool of claim 9 wherein the roller means comprise rollers and the select rail web comprises fillets, the rollers having roller radii, the fillets having fillet radii, the roller and fillet radii being substantially equal, the rollers engaging the fillets with substantially equal roller and fillet radii for enhancing device engagement with the select rail web.

11. The rail cant measurement tool of claim 3 wherein the means for measuring rail cant information comprise a rotary encoder assembly, the rotary encoder assembly being engageable with the select planar running surface for measuring the rail cant information.

12. The rail cant measurement tool of claim 3 wherein the cant-determination means comprise linear slide bearing means, the linear slide bearing means for enabling the means for measuring rail cant information to move bi-directionally thereby enabling tool use on varying rail gauges.

13. A method for measuring rail cant, the method comprising the steps of:

providing a rail cant measurement tool, the rail cant measurement tool comprising:

plane-determination means for determining a track reference plane of a track assembly, the track assembly comprising opposed rails, each rail comprising a rail head and a rail web, the plane-determination means being engageable with the opposed rails at uppermost portions of the rail heads thereby determining the track reference plane, each rail head comprising a planar running surface; and cant-determination means for determining rail cant relative to the track reference plane, the cant-determination means being cooperable with the plane-determination means and engageable with a select planar running surface and comprising means for measuring rail cant information, the rail cant information reflecting the angle of the select planar running surface relative the track reference plane;

engaging the opposed rails at uppermost portions of the rail heads via the plane-determination means thereby determining the track reference plane;

engaging a select rail head via the means for measuring rail cant information; and measuring rail cant information via the means for measuring rail cant information.

14. The method of claim 13 wherein the step of engaging the select rail head comprises the step of clamping a web-engaging arm assembly of the cant-determination means into engagement with the select rail head, the web-engaging arm assembly for positioning the means for measuring rail cant information into engagement with the select rail head.

15. The method of claim 14 wherein the web-engaging arm assembly is outfitted with roller means, the roller means for enhancing assembly-to-web engagement of the web-engaging arm assembly with the select rail web.

16. The method of claim 13 wherein the step of engaging the select rail head via the means for measuring rail cant information is enhanced by way of linear slide bearing means for enabling the means for measuring rail cant information to move bi-directionally thereby enabling tool use on varying rail gauges.

17. A method for measuring rail cant, the method comprising the steps of:

identifying a target track section, the target track section comprising opposed rail sections, each rail section comprising a rail head and a rail web;

engaging plane-determination means with the opposed rail sections at the rail heads, the plane-determination means thereby determining a track reference plane of the target track section;

engaging cant-determination means with a select rail head, the cant-determination means comprising measurement means for measuring rail cant information from the select rail head relative to the track reference plane; and measuring rail cant information by way of the cant-determination means.

18. The method of claim 17 wherein the step of engaging the cant-determination means with the select rail head comprises the step of clamping a web-engaging arm assembly of the cant-determination means into engagement with the select rail head, the web-engaging arm assembly for positioning the means for measuring rail cant information into engagement with the select rail head.

19. The method of claim 18 wherein the web-engaging arm assembly is outfitted with roller means, the roller means for enhancing assembly-to-web engagement of the web-engaging arm assembly with the select rail web.

20. The method of claim 17 wherein the step of engaging the cant-determination means with the select rail head is enhanced by way of linear slide bearing means for enabling the means for measuring rail cant information to move bi-directionally thereby enabling tool use on varying rail gauges.

* * * * *